United States Patent [19]

Bender

[11] Patent Number: 4,651,582

[45] Date of Patent: Mar. 24, 1987

[54] COUNTERBALANCED PUMPS

[76] Inventor: Emil A. Bender, 6625 Kane Way, Bakersfield, Calif. 93309

[21] Appl. No.: 822,596

[22] Filed: Jan. 27, 1986

[51] Int. Cl.[4] ..... F16H 27/02

[52] U.S. Cl. ..... 74/89.22; 74/590; 254/326; 417/415

[58] Field of Search ..... 74/37, 89.22, 589, 89.2, 74/590; 166/72; 417/415, 12, 17, 42; 254/326

[56] References Cited

U.S. PATENT DOCUMENTS

| | | | |
|---|---|---|---|
| 1,970,596 | 8/1934 | Coberly | 74/89.22 |
| 3,285,081 | 11/1966 | Kuhns et al. | 74/89.22 |
| 3,483,828 | 12/1969 | Bender | 74/590 X |
| 3,528,305 | 9/1970 | Kuhns et al. | 74/89.22 |
| 3,695,117 | 10/1972 | Ewing et al. | 74/89.22 |
| 4,052,907 | 10/1977 | Chardonneau et al. | 254/326 |
| 4,062,640 | 12/1977 | Gault | 417/415 |
| 4,076,218 | 2/1978 | Gault | 254/326 |
| 4,496,285 | 1/1985 | Albert et al. | 417/17 X |

*Primary Examiner*—Dennis L. Taylor
*Attorney, Agent, or Firm*—Michael Bak-Boychuk

[57] ABSTRACT

A long stroke pump rod articulation system includes a continuous belt loop attached to carry a connecting rod pin which engages a connecting rod secured to apply articulation forces to a belt supported counterbalance. The belts of the counterbalance oppose the extension of the pump rod articulating belt.

5 Claims, 8 Drawing Figures

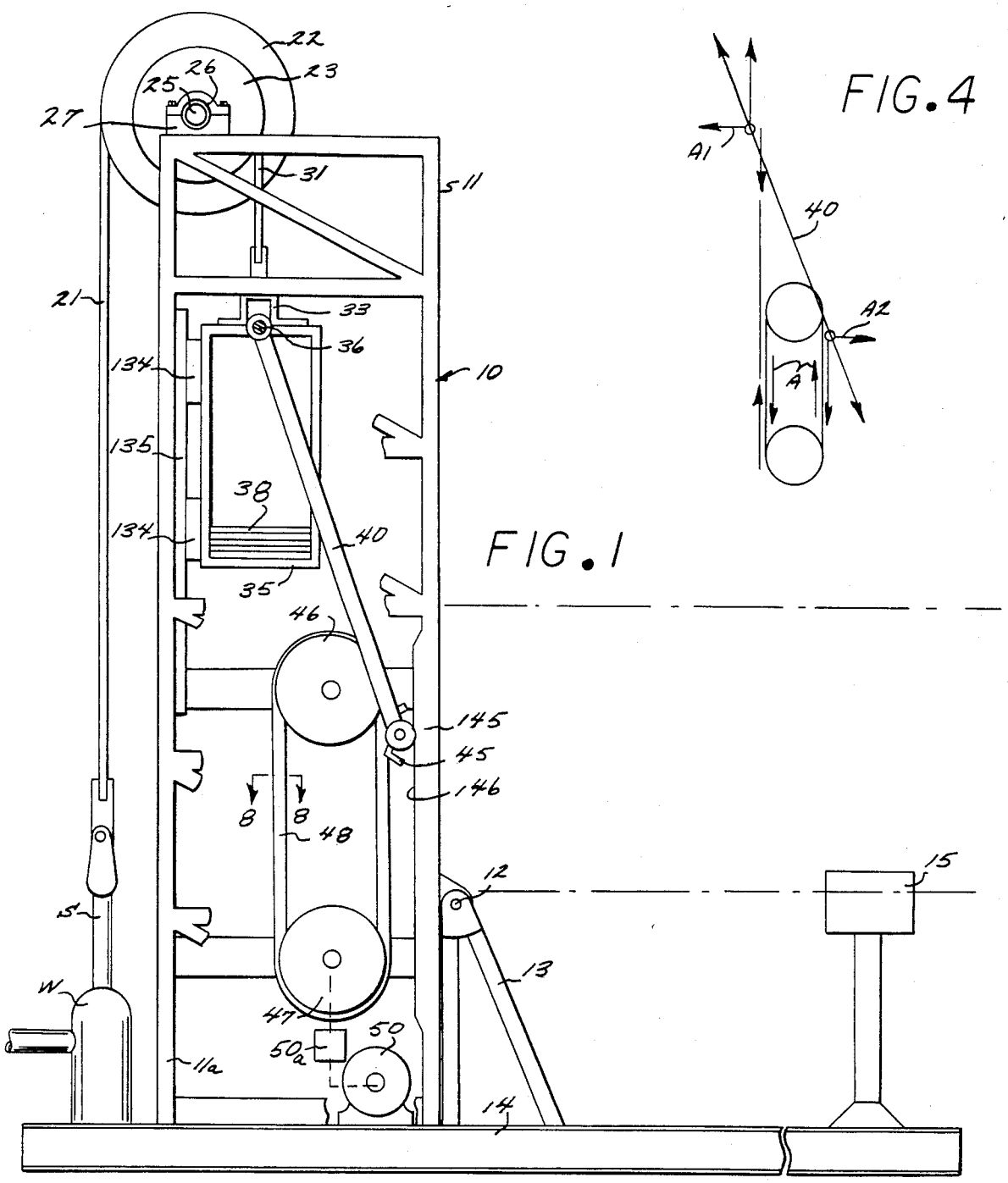
FIG. 1
FIG. 4
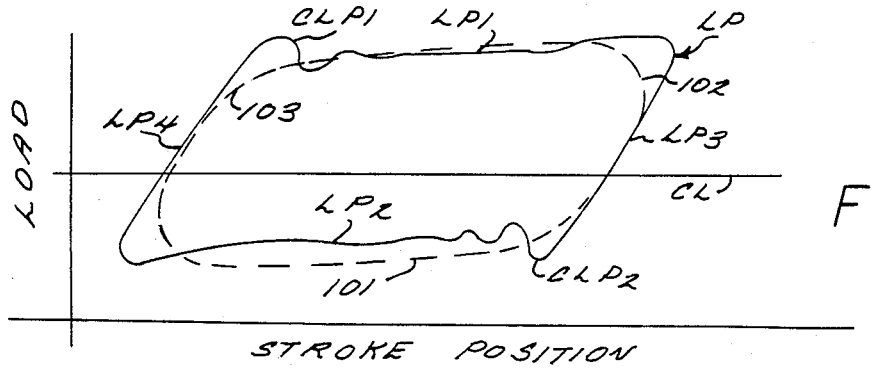
FIG. 3

COUNTERBALANCED PUMPS

BACKGROUND OF THE INVENTION

1. Field of the Invention

The present invention relates to long stroke well pumping units, and more particularly to pumping units of the counterbalanced type.

2. Description of the Prior Art

As the shallow deposits of crude oil are depleted wells at a greater depth appear with increased frequency. Characteristically the pumping of an oil well entails reciprocal articulation of a string of sucker rods and as the well depth increases the elastic component of the string often masks the motion of the downhole pump suspended on the end of the string. As a consequence pumping of deep wells is best achieved by long, low frequency, strokes, and at a stroke rate necessarily below the fundamental resonance of the rod string.

Additionally, low frequency pumping of oil wells has been recognized in the past for the conservative aspects thereof in mechanical loading, aspects which both reduce any fatigue cycle rate and more importantly, allow for more precise balancing and thus a more even power profile. (Typically, a well pump expends power to lift the fluid head in the course of each stroke. Superposed on these power demands are the power losses associated with stroke reversal, excitation of rod string modes, and other mechanical components which are not entailed in lifting the fluid. These parasitic losses diminish inversely with the length of the stroke and directly with the reduction in its frequency.) Accordingly, long stroke pumping of deep formations has had wide acceptance, acceptance which increases with the number of deep wells presently pumped.

In the past, long stroke pumps have been variously implemented. One technique utilizes cable and drum arrangements like those taught in U.S. Pat. No. 4,062,640 to Gault, or in U.S. Pat. Nos. 3,285,081 and 3,528,305 to Kuhns et al. Alternatively, the use of chain and sprocket is taught in U.S. Pat. Nos. 2,520,187 to Wilshusen et al; 1,637,078 to Hill; 1,927,831 to Hild, and 4,179,947 and 4,197,766 to James. All of the foregoing, while suitable for their purposes, operate at a counterbalance point which substantially balances out the well column weight. The prime mover, therefore, is loaded in the course of reversal of each stroke by the combined inertia of the rod string and the counterbalance mass. This dynamic component requires complex mechanisms to control the large component of wear induced by parasitic loads during reversal. The control over this dynamic component is thus a major effort in the prior art and it is this dynamic component that is conveniently resolved herein.

SUMMARY OF THE INVENTION

Accordingly, it is the general purpose and object of the present invention to provide a counterbalanced, long stroke, pumping assembly which minimizes the loads in the course of reversal.

Other objects of the invention are to provide a long stroke pumping unit which is conveniently transported to a well site.

Yet further objects of the invention are to provide a power input linkage in a long stroke pumping unit which effectively limits the frequencies excited in the course of reversal.

Briefly, these and other objects are accomplished within the present invention by providing a pivotal frame deployed on a transportable base, the frame having mounted on the free end thereof a rotary capstan assembly, comprising a larger central drum axially fixed between two smaller drums on either side thereof. The central drum is then secured to one end of a composite belt which, in the course of rotary motion, is wound thereabout, the belt attaching at the other end to the upper end of a rod string deployed in a well. The two smaller drums, in turn, wind up in opposite direction a pair of counterbalance belts connected at their free ends to a counterbalance carrier from which two counterweight assemblies are suspended. Deployed for articulation between the two counterweights and pivotally connected to the carrier at one end is a connecting rod which, at its other end, attaches to a swivel joint fixed to the exterior of a continuous belt loop stretched around an idler and a driven sheave mounted in the frame. The driven sheave then is engaged to a prime mover, reciprocating the connecting rod in the course of its rotation.

As will be shown herein the continuous belt loop is deployed to align its downward path along the line of motion of the counterbalance belts and its upward passage adjacent vertical tracks in the frame which oppose the lateral component of the connecting rod load. Concurrently the counterbalanced carriers travel adjacent vertical slides which, once again, oppose the lateral loads at the upper end of the connecting rod.

In this manner all lateral load components consequent to the connecting rod geometry are taken out, the reversal frequency being thus determined by the diameter of the idler and driven sheaves. As result a long stroke, counterbalanced, pumping arrangement is set out which in its stroke reversal portions develops well determined, geometrically controlled frequency components.

BRIEF DESCRIPTION OF THE DRAWINGS

FIG. 1 is a side view, in partial section, of a long stroke pumping system constructed according to the present invention;

FIG. 3 is a load versus stroke position graph illustrating both the prior art load curves and the load curves attainable by the inventive pumping system;

FIG. 4 is a load vector diagram illustrating the loads developed in the course of operation of the inventive pumping system;

DESCRIPTION OF THE PREFERRED EMBODIMENT

Figure 2:
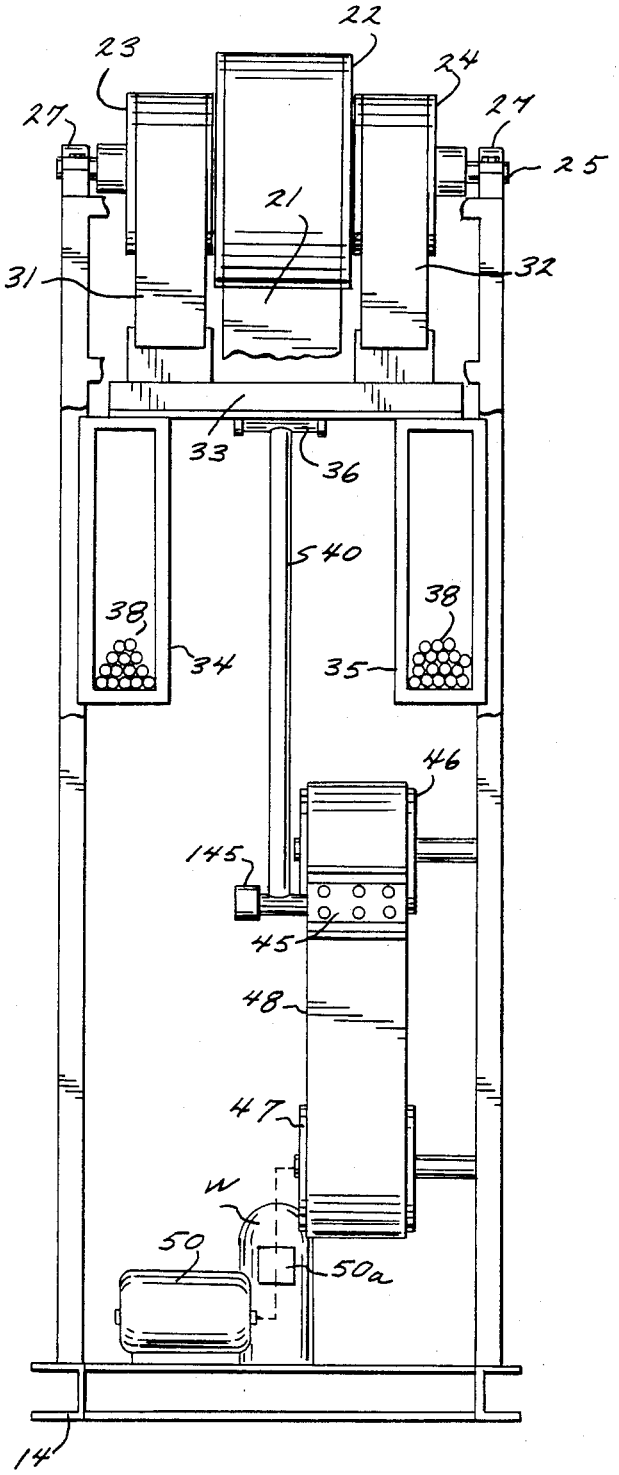
FIG. 2 is a rear view of the long stroke pumping system shown in FIG. 1.

As shown in FIGS. 1-8 the inventive long stroke pumping system, generally designated by the numeral 10, comprises a support frame 11 formed as a triangulated truss, pivotally engaged on one side to a pivot 12 at the top of a vertical stand 13 extending from a transportable platform 14. In this form frame 11 may be turned about pivot 12 to rest in a horizontal position in a support cradle 15 for transport. Once brought to a site adjacent a well W the frame 11 is raised from the cradle to align vertically adjacent a rod string S extending from well W. In this position rod string S may be attached to the free end of a belt 21 descending from a spiral stack on the periphery of a center drum 22. Drum 22, in turn, is fixed between two reduced diameter counterbalance drums 23 and 24 coaxially mounted on a central shaft 25 extending through bearings 26 fixed in pillow blocks 27 at the upper end of the frame.

In order to deploy belt 21 along a path outside the structure of frame 11 pillow blocks 27 are aligned proximate the frame edge, thus aligning the exterior periphery of drum 22 in an overhanging deployment over the well W. Belt 21 is thus deployable in the plane of motion of the rod string S by the simple expedient of placement of platform 14. Once thus erected the off-center position of the pivot 12 fixes the frame in its vertical placement with the load transferred through the legs 11*a* at the bottom thereof to the platform 14.

Wound on drums 23 and 24, in opposite direction to belt 22, are two counterbalance belts 31 and 32 which descend into the interior of frame 11 to attach to the ends of a transverse counterbalance carrier 33. Carrier 33, in turn, supports in suspension two counterbalance cages 34 and 35 at the ends thereof and a wrist pin 36 engaging the upper end of a connecting rod 40.

Rod 40, at its lower end, pivotally engages a pin carrier 45 fixed to the exterior of a V-belt loop 48 stretched around the peripheries of an idler sheave 46 and a driven sheave 47 both fixed for rotation within the interior of frame 11 in a vertical plane extending between the paths of motion of the counterbalance cages 34 and 35. Sheaves 46 and 47, moreover, are deployed in vertical alignment relative each other with one peripheral side of the sheaves aligned directly below the belt suspended counterbalance carrier. Thus a portion of the path of motion of the belt loop 48 aligns directly underneath the counterbalance carrier, particularly the downward path segment of the belt. Connecting rod 40 is thus loaded in tension in the course of the upward portion of the pumping stroke of the rod string S, a load resulting from the power input of a prime mover 50 engaged to sheave 47. Across a planetary gear reducer 50*a* such as the gear reducer sold under the mark "Planetgear" by Rexnord Inc., P.O. Box 2022, Milwaukee, Wis. 53201. Gear reducers of this kind include reverse brake assemblies in the form of pawls engaging stops to oppose reversal.

By particular reference to FIG. 3 the typical pump loading profile LP forms a generally trapezoidal pattern defined by an upward pump load segment LP1, a return pump load segment SP2 and the two reversal segments LP3 and LP4. To conserve loading this load profile straddles the counterbalance line CL, a counterbalance point selected by the counterbalance load in the counterbalance cages 34 and 35.

In order to conveniently reach this counterbalance level CL cages 34 and 35 are sized to store cut segments 38 of worn pump rod, thus allowing for balance adjustment in the field.

Referring, again, to FIG. 3 most prior art pump systems entail chronic higher frequency excitations at each reversal. Thus segment LP1 typically includes a damped cyclic component CLP1 which exists as result of rod string excitation in the course of reversal. Similarly segment LP2 includes a cyclic component CLP2 right after reversal. Both these cyclic load patterns CLP1 and CLP2 grossly aggravate the fatigue rate of the rod string S and are controllable only by close control over the spectral content in each stroke reversal. Simply, excitation of the rod string modes of resonance will occur if the reversal sequence includes frequencies in that bandpass.

In the past substantial cost and mechanism complexity was applied to reduce these reversal induced excitations. Instantly, however, reversal shaping is conveniently achieved by the radial dimension of sheaves 46 and 47. Thus, the load profile developed by the instant mechanism, shown generally as the profile 101 in FIG. 3, includes reversal segments 102 and 103 defined by the radial geometry of the sheaves.

By reference to FIG. 4 the load vector geometry resulting from the articulation of rod 40 in the course of advancement of belt 48 includes lateral components Al and A2 only when rod 40 is at an angle relative the path of the carriers 33. This occurs mainly when the pin carrier 45 is on the upward portion of belt 48, as illustrated by the arrow A. To oppose the lateral load Al thus developed each counterbalance cage 34 and 35 is provided with skids 134 of a low friction polymer like Teflon which oppose slides or rails 135 of similar material aligned vertically within the adjacent structure of frame 11. Similarly, pin carrier 45 may include a roller 145 opposing a rail 146 aligned in frame 11 along the upward portion of the belt loop 48.

Thus, all lateral loads developed by the connecting rod linkage are directly transferred to the supporting structure. Moreover, substantial isolation of higher frequency (shock or impact) loading is achieved by applying the motive force directly to the counter balance. This occurs in consequence to the effective compounding of the spring mass system, a compounding which couples the spring mass combination of the counterbalance with the rod string modes.

One should note that the input of a forcing function (the connecting rod input) to the counterbalance carrier will result in substantial isolation of the higher frequency components. Classic vibration theory concludes that an input to a multiple degree of freedom system through the higher frequency end will tend to transfer the energy to the coupled mode fundamental response. See, for example, Timoshenko, S.P., Vibration Problems in Engineering, 3d Ed D. Van Nostrand Co., Inc., 1955.

Accordingly, the instant invention, unlike the prior art, applies the force input to the counterbalance, thus absorbing unwanted excitations within the counterbalance suspension. Moreover, this force input is controlled by the shape of sheaves 46 and 47.

Figure 5:
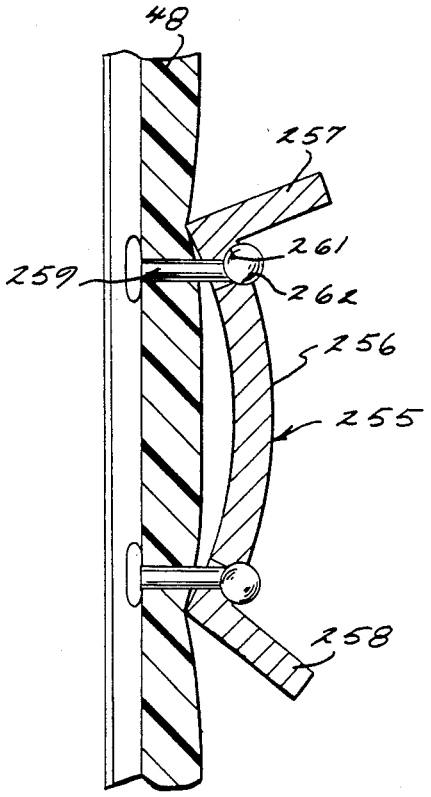
FIG. 5 is a detail side view, in section, of a pin carrier useful with the invention herein.
Figure 6:
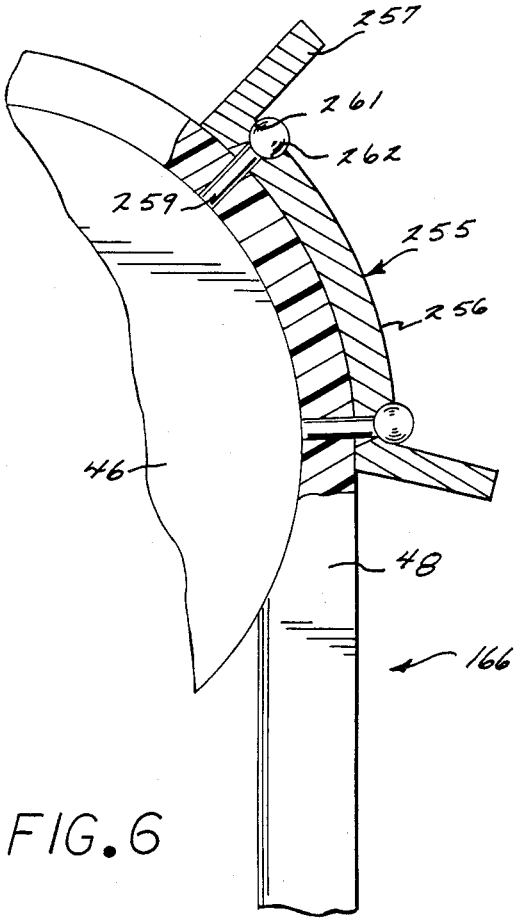
FIG. 6 is yet another side view detail illustrating the passage of the pin carrier over a sheave.
Figure 8:
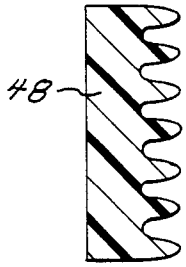
FIG. 8 is a sectional view taken along line 8—8 of FIG. 1.
Figure 7:
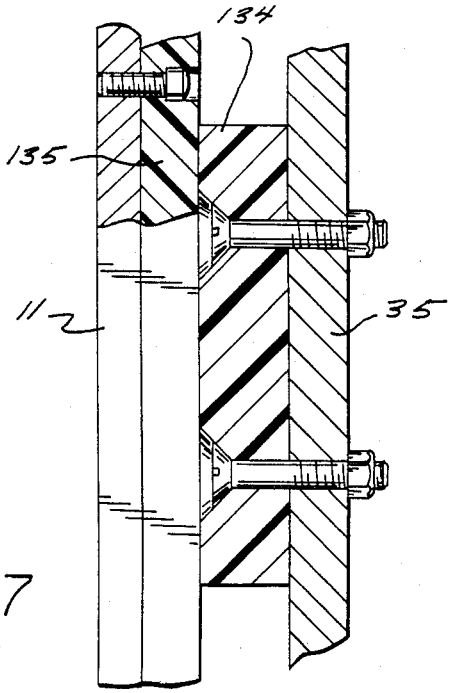
FIG. 7 is a side view detail of a slide arrangement useful with the invention herein.

To further limit the occurrences of higher frequency input at the connecting rod pin carrier 45, as more clearly shown in FIG. 5, comprises a channel section 255 provided with a curved center wall 256 extending between two edge elements 257 and 258 for increased stiffness. Section 255 is fixed to the belt loop 48 by attachments 259 fixed at the juncture with the edge elements 257 and 258, thus allowing the belt loop to curve into the curvature of wall 256 as it passes around the sheaves 46 and 47. For this reason the curvature radius of wall 256 conforms to the radius of the sheaves.

In addition attachments 259 are in the form of round headed rivets each including a convex head base 261 received in conforming seats 262 in wall 256 to extend shanks 263 into the mass of the V-belt loop 48 at an angle which approximates the arc of the sheave subtended. As the V protrusions of the belt loop 48 pass over the sheaves the belt curvature is accommodated by the rivet head motion to allow for dimension changes without the associated shock.

In this form a convenient pump arrangement is provided which allows for a long stroke with minimal loading at reversals.

Obviously many modifications and changes may be made to the foregoing without departing from the spirit of the invention. It is therefore intended that the scope of the invention be determined solely on the claims appended hereto.

What is claimed is:

1. A counterbalanced pump conformed for reciprocating a rod string disposed in a well, comprising:

a frame adapted for vertical placement adjacent said well, said frame including an upper end and a base for support thereof on ground;

roller means mounted for rotation on said upper end of said frame;

a first flexible belt assembly connected at one end thereof to said roller means and wrapped thereabout in a first direction for attachment as the other end thereof to said rod string;

a second flexible belt assembly connected at one end thereof to said roller means and wrapped thereabout in a second direction, whereby the rotation fo said roller means will cause an opposite effect on the extension of said first and second belts;

counterweight means connected to the other end of said second belt assembly;

a first and second rotary guide means mounted for rotation on said frame in spaced, coplanar, deployment relative each other;

a continuous flexible loop disposed around the common exterior of said first and second guide means;

a prime mover connected for rotary advancement of said first guide means; and a connecting rod operatively engaged at one end thereof to a segment on said continuous loop and at the other end to said counterweight means for imparting a reciprocal force to said counterweight means in the course of rotary advancement of said loop.

2. Apparatus according to claim 1 wherein:

said first and second guide means comprise rotary sheaves; and said continuous loop comprises a V-belt.

3. Apparatus according to claim 1 wherein:

said roller means includes a central roller fixed coaxially between lateral rollers on either side thereof, said central roller being of a diameter larger than said lateral rollers;

said first, central, flexible belt assembly comprises a reinforced composite flexible belt aligned for spiral deployment on said central roller; and said second flexible belt assembly comprises a pair of lateral reinforced composite belts respectively aligned for spiral deployment on said lateral rolls in a direction opposite to said frist central belt.

4. Apparatus according to claim 1 further comprising:

a pivotal mount attached to said exterior of said loop including an arcuate bracket secured on said loop of an arc radius substantially equal to the radius of said first and second sheave, said bracket including a pivot extending therefrom in a direction transverse to said loop for pivotal engagement of said of one end of said connecting rod.

5. Apparatus in accordance with claim 4 wherein:

said bracket further includes a roller; and said frame includes a track segment aligned to oppose said roller over a portion of travel of said bracket.

* * * * *